US010665446B2

(12) United States Patent
Verkerk et al.

(10) Patent No.: US 10,665,446 B2
(45) Date of Patent: May 26, 2020

(54) SURFACE LAYER DISRUPTION AND IONIZATION UTILIZING AN EXTREME ULTRAVIOLET RADIATION SOURCE

(71) Applicant: Rapiscan Systems, Inc., Torrance, CA (US)

(72) Inventors: Udo H. Verkerk, Toronto (CA); Vladimir Romanov, Pelham, NH (US); Alison Jennings, Newmarket (CA); Hanh T. Lai, Arlington, MA (US); Alan C. Hopkinson, Nobleton (CA)

(73) Assignee: Rapiscan Systems, Inc., Torrance, CA (US)

( * ) Notice: Subject to any disclaimer, the term of this patent is extended or adjusted under 35 U.S.C. 154(b) by 0 days.

(21) Appl. No.: 16/256,032

(22) Filed: Jan. 24, 2019

(65) Prior Publication Data

US 2019/0228959 A1 Jul. 25, 2019

Related U.S. Application Data

(60) Provisional application No. 62/621,375, filed on Jan. 24, 2018.

(51) Int. Cl.
*H01J 49/00* (2006.01)
*H01J 49/04* (2006.01)
(Continued)

(52) U.S. Cl.
CPC ..... *H01J 49/049* (2013.01); *H01J 27/24* (2013.01); *H01J 49/0031* (2013.01);
(Continued)

(58) Field of Classification Search
CPC ..... H01J 49/00; H01J 49/02; H01J 49/049; H01J 49/0418; H01J 49/0031; H01J 49/0404; H01J 49/0409; H01J 49/0463; H01J 49/10; H01J 49/16; H01J 49/161; H01J 49/162; H01J 49/164
(Continued)

(56) References Cited

U.S. PATENT DOCUMENTS 3,067,560 A 12/1962 Frederick
3,705,480 A 12/1972 Wireman
(Continued)

FOREIGN PATENT DOCUMENTS

AT 303589 T 9/2005
AT 480769 T 9/2010
(Continued)

OTHER PUBLICATIONS

International Search Report for PCT/US19/14872, dated Aug. 6, 2019.
(Continued)

*Primary Examiner* — Jason L McCormack
(74) *Attorney, Agent, or Firm* — Novel IP

(57) ABSTRACT

A surface ionizer for a trace detection system includes an extreme ultraviolet light source and an ion transfer line. Activation of the extreme ultraviolet light disrupts a surface of a sample along with residue and ionizes the resulting vapor. The ionized vapor is collected in the ion transfer line and passed into an analysis device for detection of components in the vapor.

18 Claims, 5 Drawing Sheets

(51) Int. Cl.
*H01J 49/06* (2006.01)
*H01J 49/16* (2006.01)
*H01J 27/24* (2006.01)

(52) U.S. Cl.
CPC ..... *H01J 49/0495* (2013.01); *H01J 49/062* (2013.01); *H01J 49/161* (2013.01); *H01J 49/162* (2013.01)

(58) Field of Classification Search
USPC ..... 250/281, 282, 288
See application file for complete search history.

(56) References Cited

U.S. PATENT DOCUMENTS 4,858,335 A 8/1989 Roth
5,350,442 A 9/1994 Thelen
5,491,337 A 2/1996 Jenkins
5,554,846 A 9/1996 Regiec
5,970,804 A 10/1999 Robbat, Jr.
6,211,516 B1 4/2001 Syage
6,326,615 B1 12/2001 Syage
6,329,653 B1 12/2001 Syage
6,630,664 B1 10/2003 Syage
6,642,513 B1 11/2003 Jenkins
6,690,005 B2 2/2004 Jenkins
6,708,572 B2 3/2004 Jenkins
6,726,886 B2 4/2004 Shiramizu
6,737,642 B2 5/2004 Syage
6,765,198 B2 7/2004 Jenkins
6,815,670 B2 11/2004 Jenkins
6,831,273 B2 12/2004 Jenkins
6,840,122 B1 1/2005 Jenkins
7,014,683 B2 3/2006 Vierling
7,047,829 B2 5/2006 Napoli
7,109,476 B2 9/2006 Hanold
7,119,342 B2 10/2006 Syage
7,141,786 B2 11/2006 McGann
7,161,144 B2 1/2007 Syage
7,196,325 B2 3/2007 Syage
7,253,727 B2 8/2007 Jenkins
7,299,710 B2 11/2007 Syage
7,320,725 B2 1/2008 Arno
7,338,638 B2 3/2008 McGann
7,361,206 B1 4/2008 Jahn
7,401,498 B2 7/2008 Syage
7,448,248 B2 11/2008 Carey
7,456,393 B2 11/2008 Napoli
7,528,367 B2 5/2009 Haigh
7,541,577 B2 6/2009 Davenport
7,594,422 B2 9/2009 Perry
7,594,447 B2 9/2009 Napoli
7,663,099 B2 2/2010 Reda
7,721,588 B2 5/2010 Perry
7,856,898 B2 12/2010 Carey
7,880,137 B2 2/2011 McGann
8,161,830 B2 4/2012 Boudries
8,186,234 B2 5/2012 Syage
8,288,735 B2 10/2012 Syage
8,402,842 B2 3/2013 Syage
8,434,375 B1 5/2013 Syage
8,614,582 B2 12/2013 Syage
8,686,355 B2 4/2014 Patterson
8,723,111 B2 5/2014 Syage
8,857,278 B2 10/2014 Syage
8,866,073 B2 10/2014 Goedecke
8,952,327 B2 2/2015 Patterson
9,147,565 B1 9/2015 Goedecke
9,354,153 B2 5/2016 Syage
9,482,655 B2 11/2016 Vilkov
9,528,969 B2 12/2016 Shaw
9,558,924 B2 1/2017 Syage
9,683,981 B1 6/2017 Vilkov
9,689,857 B1 6/2017 Vilkov
9,726,655 B2 8/2017 Syage
9,766,218 B2 9/2017 Lai
9,789,434 B1 10/2017 Lai
2002/0179832 A1* 12/2002 Fischer ..... G01N 30/7253 250/288
2003/0164091 A1 9/2003 Hill
2005/0194530 A1* 9/2005 Thakur ..... H01J 49/062 250/288
2009/0152458 A1 6/2009 Vilkov
2010/0090105 A1* 4/2010 Liang ..... H01J 49/0418 250/288
2010/0215716 A1* 8/2010 Troxel ..... A61B 17/7002 424/423
2011/0272571 A1 11/2011 Kenttaemaa
2012/0037797 A1 2/2012 Li
2012/0248301 A1* 10/2012 Short ..... H01J 49/162 250/282
2014/0291506 A1* 10/2014 Tikhonski ..... H05H 1/2406 250/282
2015/0292077 A1 10/2015 Allain
2015/0371807 A1 12/2015 Hendrikse
2016/0282304 A1 9/2016 Vilkov
2017/0103880 A1 4/2017 Syage
2017/0207075 A1* 7/2017 Quarmby ..... H01J 49/165
2017/0213715 A1 7/2017 Davila
2017/0261483 A1 9/2017 Vilkov
2017/0261484 A1 9/2017 Vilkov
2017/0284977 A1 10/2017 Rogers
2017/0309463 A1 10/2017 Vilkov
2018/0012745 A1* 1/2018 Trimpin ..... H01J 49/044
2018/0158665 A1 6/2018 Eiceman
2018/0164189 A1 6/2018 Bilodeau
2018/0172635 A1 6/2018 Lai
2018/0172650 A1 6/2018 Platow
2018/0182603 A1 6/2018 Schmidt
2018/0182604 A1 6/2018 Lai
2018/0283993 A1 10/2018 Shaw
2018/0284081 A1 10/2018 Shaw
2018/0356320 A1 12/2018 Romanov
2019/0011421 A1 1/2019 Rogers
2019/0046974 A1 2/2019 Meketa
2019/0204274 A1 7/2019 Eiceman
2019/0228959 A1 7/2019 Verkerk

FOREIGN PATENT DOCUMENTS

CA 2153371 C 3/1999
CA 2436256 C 6/2007
CA 2382823 C 11/2007
CA 2362449 C 10/2008
CA 2411532 C 4/2010
CA 2285153 C 5/2010
CA 2479875 C 2/2011
CA 2538709 C 2/2013
CA 2790430 A1 3/2013
CA 2807894 A1 9/2013
CA 2620405 C 7/2014
CA 2548177 C 9/2014
CA 2844222 A1 9/2014
CA 2845959 A1 9/2014
CA 2688352 C 6/2015
CA 2644937 C 11/2015
CA 2904479 A1 3/2016
CA 2910780 A1 4/2016
CA 2913931 A1 6/2016
CA 2915785 A1 6/2016
CA 2924580 A1 9/2016
CA 2647651 C 11/2016
CA 2738053 C 5/2017
CA 2959791 A1 9/2017
CA 2959796 A1 9/2017
CA 2962154 A1 9/2017
CA 2964147 A1 10/2017
CN 100445767 C 12/2008
CN 103308590 A 9/2013
CN 103797559 A 5/2014
CN 105738461 A 7/2016
CN 107037114 A 8/2017
CN 107167334 A 9/2017

(56) References Cited

FOREIGN PATENT DOCUMENTS

| | | | |
|---|---|---|---|
| CN | 107167335 | A | 9/2017 |
| CN | 107271254 | A | 10/2017 |
| DE | 69528418 | T2 | 1/2003 |
| DE | 69926965 | T2 | 6/2006 |
| EP | 1048540 | A1 | 11/2000 |
| EP | 2368102 | A2 | 9/2011 |
| EP | 2587259 | A1 | 5/2013 |
| EP | 2637013 | A2 | 9/2013 |
| EP | 2778650 | A2 | 9/2014 |
| EP | 2778669 | A1 | 9/2014 |
| EP | 2884254 | A1 | 6/2015 |
| EP | 3015858 | A1 | 5/2016 |
| EP | 3032570 | A2 | 6/2016 |
| EP | 3040717 | A1 | 7/2016 |
| EP | 1938078 | B1 | 3/2017 |
| EP | 1297554 | B1 | 4/2017 |
| EP | 3182111 | A1 | 6/2017 |
| ES | 2183855 | | 4/2003 |
| FR | 692712 | A | 11/1930 |
| GB | 992782 | A | 5/1965 |
| GB | 2075578 | A | 11/1981 |
| GB | 2496286 | A | 5/2013 |
| GB | 2536076 | A | 9/2016 |
| JP | 3045655 | B2 | 5/2000 |
| JP | 2006064325 | | 3/2006 |
| WO | 0209847 | A2 | 2/2002 |
| WO | 2016179291 | A1 | 11/2016 |

OTHER PUBLICATIONS

Cody et al., "Versatile New Ion Source for the Analysis of Materials in Open Air under Ambient Conditions", Anal. Chem., 2005, vol. 77, pp. 2297-2302.

* cited by examiner

SURFACE LAYER DISRUPTION AND IONIZATION UTILIZING AN EXTREME ULTRAVIOLET RADIATION SOURCE

CROSS-REFERENCE

The present specification relies on, for priority, U.S. Patent Provisional Application No. 62/621,375 entitled "Surface Layer Disruption and Ionization Utilizing an Extreme Ultraviolet Radiation Source", filed on Jan. 24, 2018, which is incorporated by reference herein in its entirety.

FIELD

The field of the disclosure relates generally to trace detection systems and, more particularly, to systems and methods for removal and ionization of surface residues using extreme ultraviolet (EUV) radiation.

BACKGROUND

Various technologies exist for detecting residues of certain substances of interest, such as explosives and illicit drugs. Some trace detection technologies use spectrometric analyses of ions formed by the ionization of vaporized substances of interest. Spectrometric analyses include ion mobility spectrometry and mass spectrometry, for example, both of which are common in trace detection.

A general requirement for the trace detection of explosives by mass spectrometry and ion mobility spectrometry is the transfer of surface deposited explosives into a gas phase as neutrals or ions, independent of the morphology and/or chemistry of both the explosives and the surface. Currently available methods operating at atmospheric pressure consist of either evaporating the analyte by thermal energy from a surface, followed by an ionization step using ions generated by a bipolar ion source (a low temperature plasma) or unipolar ion source (created by, for instance, an electrospray source) before ion mobility or mass spectrometry analysis, or surface disruption by dissolving the analyte followed by an electric-field-induced surface lift-off of ionic components created or deposited on the surface. The thermal evaporation step has limited compatibility with thermally sensitive surfaces and requires either a radioactive source of ions or an AC or DC plasma source of ions. The disruption by surface solvation requires the additional modification of instrumentation and suffers from low sensitivity, while electrode erosion and ozone generation may be caused by AC and DC plasma sources.

Conventionally, a surface may be swabbed using material such as polytetrafluoroethylene coated fiberglass to physically separate residue from a surface for analysis. The material containing the surface residue, also referred to as a trap, is then heated to vaporize the residue into a gas phase. For example, the trap may be introduced to an inlet of a desorber, where the trap is rapidly heated to a desired temperature by a heating element to vaporize the residue. Because it is necessary to ionize the vaporized residue before mobility or mass spectrometry analyses can take place, the vaporized residue is transported from a vaporization region to a separate ionization region in which ionization is performed using ions generated by a bipolar ion source or a unipolar ion source. The resulting ionized gas phase is then transferred to an analysis device or a detector for spectrometric analysis where it is screened for the substance of interest.

U.S. Pat. No. 8,742,363, titled 'Method and apparatus for ionizing gases using UV radiation and electrons and identifying said gases', discloses "a method for ionizing and identifying gases, wherein the gases to be identified are ionized in a reaction chamber and the product ions are measured, wherein the measurement of the product ions takes place via electrical fields acting on the product ions and the detection is performed with a detector for ions. It is provided that ionization takes place via UV radiation, and that simultaneously or sequentially ionization by electrons takes place."

U.S. Pat. No. 5,968,837, titled 'Photo-ionization ion mobility spectrometry', discloses "a method for photo-ionization ion mobility spectrometry, a reagent gas is added, in particular an aromatic compound, which has a large ionization cross section in the range of ionizing VUV radiation, but a low probability for the formation of protonated quasi-molecular ions. In this way, the detection of only weakly proton affine substances is also amplified or even made possible at all, and also the detection of electronegative substances in a negative operating mode is improved."

U.S. Pat. No. 5,969,349, titled 'Ion mobility spectrometer', discloses an "ion mobility spectrometer with a non-radioactive electron source to generate ions inside a reaction chamber. The reaction chamber consists of two partial chambers, one of which is evacuated and comprises the electron source, and the other one is connected to the drift chamber of the IMS via a shutter grid. The partition wall between both partial chambers is transparent to electrons but impermeable for gas molecules. The electron source may comprise a thermoemitter or a photocathode, which is illuminated from outside through a window."

U.S. Pat. No. 6,586,729, titled 'Ion mobility spectrometer with non-radioactive ion source', discloses "an ion mobility spectrometer (IMS) that has a non-radioactive electron source in an evacuated chamber that is separated from the reaction chamber of the IMS by an x-ray window. Electrons from the source impinge upon an x-ray anode, causing the emission of x-ray radiation toward the window. A current controller is provided by which currents in the electron-source chamber are monitored and controlled using a microprocessor circuit. If a maximum permissible residual gas pressure is exceeded, the electron source is automatically shut down and a gettering process is activated."

U.S. Pat. No. 6,429,426, titled 'Ionization chamber with electron source', discloses an "ionization chamber, especially for an ion mobility spectrometer, with a non-radioactive electron source. The chamber consists of two compartments, of which one is evacuated and contains an electron source, and the other represents the reaction chamber of the IMS. In the evacuated compartment, X-ray quanta are produced in an anode by electron bombardment and these X-ray quanta can penetrate a partition between the two compartments. The partition between the two compartments is impermeable to electrons from the source and to gas molecules. In one or several conversion layers within the reaction compartment, X-ray quanta are converted to quanta of a lower energy and/or photoelectrons that can ionize the air constituents at a high level of efficiency."

United States Patent Application No. 2002/0185594, titled 'Ion mobility spectrometer with mechanically stabilized vacuum-tight x-ray window', discloses that "an ion mobility spectrometer (IMS) has a non-radioactive electron source and an x-ray anode in an evacuated chamber. The impinging of electrons from the source on the anode results in the generation of x-ray radiation. The x-ray radiation passes through a window that provides a vacuum barrier between the electron source chamber and a reaction chamber of the IMS by an x-ray window. A support grid is attached to the reaction-chamber side of the x-ray window, and mechanically stabilizes the window."

Such conventional trace detection systems that require the use of a trap or other means for obtaining a sample have significant drawbacks including limitations in throughput and scalability. The physical act of removing surface material requires a process separate from the actual analysis, and the throughput of sample heating, such as in a desorber, may be limited due to the time needed to cool the desorber to accept a subsequent sample.

It is realized herein that the use of a trap and separate desorber may limit the performance and scalability of a trace detection system. The downtime between heat up and cool down of a desorber limits its throughput. Additionally, the required heating and cooling system may be excessively bulky and unable to be downscaled, requiring a fixed system that is not easily transported or handled in the field. In addition, the trace detection system requires consumable goods such as a trap for removal of surface residues from an object being tested.

Hence, there is need for a trace detection system that does not require a desorber and a separate ionization step. There is also need for a trace detection system that can be used to detect a wide range of substrate materials, can easily be miniaturized, has a rapid cycle time, and relatively low power requirements. There is also need for a trace detection system that does not cause ozone formation and has a small footprint.

SUMMARY

The following embodiments and aspects thereof are described and illustrated in conjunction with systems, tools and methods, which are meant to be exemplary and illustrative, not limiting in scope.

The present specification discloses a surface ionizer comprising: a housing having a sampling area; a radiation source positioned within the housing and configured to emit electromagnetic radiation towards the sampling area, wherein the electromagnet radiation has a wavelength distribution between 10 nanometers and 124 nanometers; and an ion transfer line coupled to the housing, the ion transfer line in fluid communication with the sampling area and configured to direct ionized vapor from the sampling area to an analysis device.

Optionally, the ion transfer line is external to the housing, comprises materials that are non-reactive and is positioned within a range of 1 mm to 40 mm of the radiation source. Optionally, the housing encapsulates both the radiation source and the ion transfer line.

Optionally, the sampling area comprises a sampling chamber having an opening for receiving a sample, wherein an end of the ion transfer line is disposed in a wall of the sampling chamber and the opening for receiving a sample is disposed on an opposite side of the sampling chamber from the ion transfer line.

Optionally, the sampling area comprises a sampling chamber having a wall having an exterior surface, an interior surface, and at least one open passage between the exterior surface and the interior surface.

Optionally, the surface ionizer further comprises a heating element positioned in the housing and configured to heat the ion transfer line to a temperature greater than 130 degrees Celsius.

Optionally, the ion transfer line is configured to direct ionized vapor by way of at least one of an electrostatic force gradient or a pressure gradient for enabling the ionized vapor to move towards the analysis device.

The present specification also discloses a method of operating a trace detection system for detecting a substance of interest within a sample, the method comprising: positioning a sample proximate an electromagnetic radiation source and an ion transfer line; activating the electromagnetic radiation source to produce electromagnetic radiation having a wavelength distribution between 10 nanometers and 124 nanometers; directing the electromagnetic radiation onto a surface of the sample to disrupt material at the surface along with residue at the surface and ionize the resulting vapor to generate ionized vapor; collecting the ionized vapor in the ion transfer line; and transferring the ionized vapor from the ion transfer line to an analysis device configured to screen the vapor for the substance of interest.

Optionally, positioning the sample comprises moving the sample to within a distance ranging from 1 mm to 20 mm of the electromagnetic radiation source and ion transfer line.

Optionally, positioning the sample comprises swabbing an object with a trap and moving the trap to within a distance ranging from 1 mm to 20 mm of the electromagnetic radiation source and the ion transfer line.

Optionally, the method further comprises deactivating the electromagnetic radiation source after transferring the ionized vapor from the ion transfer line to the analysis device, the deactivation being controlled by at least one of a safety switch, a software based time delay switch or an intensity threshold sensor of the analysis device.

Optionally, the electromagnetic radiation source is activated for a length of time based on a type of ions in the ionized vapor detected by the analysis device.

Optionally, the ionized vapor is collected by the ion transfer line by a flow of air obtained by creating a pressure difference between the sampling area and the analysis device.

Optionally, a housing secures the electromagnetic radiation source and the ion transfer line and contains a sample chamber operable to secure the sample, wherein the electromagnetic radiation is directed at a side of the sample facing the ion transfer line and wherein the electromagnetic radiation source and the ion transfer line are positioned in a range of 1 mm to 40 mm from each other.

Optionally, the electromagnetic radiation is directed to a first side of the sample and the ion transfer line is directed at a second side of the sample opposite the first side.

Optionally, collecting the ionized vapor includes generating the air flow at a rate between 50 milliliters per minute and 2000 milliliters per minute.

Optionally, the electromagnetic radiation source disrupts the surface of the sample through ablation by electromagnetic radiation of the sample.

Optionally, the substance of interest includes at least one of an explosive, an energetic material, a taggant, a narcotic, a pharmaceutical product, a toxin, a chemical warfare agent, a biological warfare agent, a pollutant, a pesticide, a toxic industrial chemical, a toxic industrial material, a homemade explosive, a pharmaceutical trace contaminant, a biomarker for medical applications, a chemical marker for medical applications, a biomarker for clinical hygienic applications, a chemical marker for clinical hygienic applications, a precursor thereof, a byproduct thereof, a metabolite thereof, or combinations thereof.

Optionally, the analysis device includes at least one of an ion mobility spectrometer (IMS), an ion trap mobility spectrometer (ITMS), a drift spectrometer (DS), a non-linear drift spectrometer, a field ion spectrometer (FIS), a radio frequency ion mobility increment spectrometer (IMIS), a field asymmetric ion mobility spectrometer (FAIMS), an ultra-high-field FAIMS, a differential ion mobility spectrometer (DIMS) and a differential mobility spectrometer (DMS), a traveling wave ion mobility spectrometer, a semiconductor gas sensor, a raman spectrometer, a laser diode detector, a mass spectrometer (MS), an electron capture detector, a photoionization detector, a chemiluminescence-based detector, an electrochemical sensor, an infrared spectrometer, a lab-on-a-chip detector, or combinations thereof.

The present specification also discloses a system for detecting a substance of interest within a sample, the system comprising: a surface ionizer configured to disrupt the surface of a sample, ionize the resulting gas, and transfer the ionized gas for further analysis, wherein the surface ionizer comprises a sampling area, a radiation source configured to output a band of electromagnetic radiation towards the sampling area, and an ion transfer line coupled to the housing, the ion transfer line in fluid communication with the sampling area and configured to direct ionized vapor from the sampling area to an analysis device; and an analysis device configured to screen the vapor for the substance of interest.

The present specification also discloses a surface ionizer comprising: a housing having a sampling area; a radiation source configured to emit a band of electromagnetic radiation towards the sampling area, the band of electromagnetic radiation having a wavelength distribution between 10 nanometers and 124 nanometers; and an ion transfer line coupled to the housing, the ion transfer line in fluid communication with the sampling area and configured to direct ionized vapor from the sampling area to an analysis device.

Optionally, the radiation source is coupled to the housing.

Optionally, the housing encapsulates the radiation source and the ion transfer line.

Optionally, the sampling area comprises a sampling chamber having an opening for receiving a sample, wherein an end of the ion transfer line is disposed in a wall of the sampling chamber and the opening for receiving a sample is disposed on an opposite side of the sampling chamber from the ion transfer line.

Optionally, the sampling area comprises a sampling chamber having a wall having an exterior surface, an interior surface, and at least one passage between the exterior surface and the interior surface.

Optionally, the ion transfer line is heated to a temperature greater than 130 degrees Celsius.

Optionally, the ion transfer line directs ionized vapor by way of an electrostatic force gradient.

The present specification also discloses a method of operating a trace detection system for detecting a substance of interest within a sample, the method comprising: positioning a sample proximate an electromagnetic radiation source and an ion transfer line; activating the electromagnetic radiation source to produce a band of electromagnetic radiation having a wavelength distribution between 10 nanometers and 124 nanometers; directing the electromagnetic radiation onto a surface of the sample to disrupt material at the surface along with residue at the surface and ionize the resulting vapor; collecting the ionized vapor in an ion transfer line; and transferring the ionized vapor from the ion transfer line to an analysis device configured to screen the vapor for the substance of interest.

Optionally, positioning a sample comprises moving the electromagnetic radiation source and ion transfer line to the sample.

Optionally, positioning a sample comprises swabbing an object with a trap and moving the trap to the electromagnetic radiation source and the ion transfer line.

Optionally, the method further comprises deactivating the electromagnetic radiation source after transferring the ionized vapor from the ion transfer line to the analysis device.

Optionally, the electromagnetic radiation source is activated for a length of time dependent on a material comprising the sample.

Optionally, the ionized vapor is collected by the ion transfer line by a flow of air.

Optionally, a housing secures the electromagnetic radiation source and the ion transfer line, and contains a sample chamber operable to secure the sample, wherein the electromagnetic radiation is directed at a side of the sample facing the ion transfer line. The electromagnetic radiation may be directed to a first side of the sample and the ion transfer line may be directed at a second side of the sample opposite the first side. Collecting the ionized vapor may include generating the air flow at a rate between 50 milliliters per minute and 2000 milliliters per minute.

Optionally, the electromagnetic energy disrupts the sample surface through ablation.

Optionally, the substance of interest includes at least one of an explosive, an energetic material, a taggant, a narcotic, a pharmaceutical product, a toxin, a chemical warfare agent, a biological warfare agent, a pollutant, a pesticide, a toxic industrial chemical, a toxic industrial material, a homemade explosive, a pharmaceutical trace contaminant, a biomarker for medical applications, a chemical marker for medical applications, a biomarker for clinical hygienic applications, a chemical marker for clinical hygienic applications, a precursor thereof, a byproduct thereof, a metabolite thereof, and combinations thereof.

Optionally, the analysis device includes at least one of an ion mobility spectrometer (IMS), an ion trap mobility spectrometer (ITMS), a drift spectrometer (DS), a non-linear drift spectrometer, a field ion spectrometer (FIS), a radio frequency ion mobility increment spectrometer (IMIS), a field asymmetric ion mobility spectrometer (FAIMS), an ultra-high-field FAIMS, a differential ion mobility spectrometer (DIMS) and a differential mobility spectrometer (DMS), a traveling wave ion mobility spectrometer, a semiconductor gas sensor, a raman spectrometer, a laser diode detector, a mass spectrometer (MS), an electron capture detector, a photoionization detector, a chemiluminescence-based detector, an electrochemical sensor, an infrared spectrometer, a lab-on-a-chip detector, and combinations thereof.

In one aspect, a surface ionizer is provided. The surface ionizer includes a housing having a sampling area, a radiation source, and an ion transfer line. The radiation source is configured to emit a band of electromagnetic radiation having a wavelength distribution between 10 nanometers and 124 nanometers towards the sample area. The ion transfer line is coupled to the housing and is in fluid communication with the sampling area and is configured to direct ionized vapor from the sampling area to an analysis device.

In another aspect, a method of operating a trace detection system for detecting a substance of interest within a sample is provided. The method includes positioning a sample proximate an electromagnetic radiation source and an ion transfer line. The method further includes activating the electromagnetic radiation source to produce a band of electromagnetic radiation having a wavelength distribution between 10 nanometers and 124 nanometers. The method further includes directing the electromagnetic radiation onto a surface of the sample to disrupt material at the surface along with residue at the surface and ionize the resulting vapor. The method further includes collecting the ionized vapor in an ion transfer line and transferring the ionized vapor from the ion transfer line to an analysis device configured to screen the ionized vapor for the substance of interest.

In yet another aspect, a system for detecting a substance of interest within a sample is provided. The system includes a surface ionizer and an analysis device. The surface ionizer is configured to disrupt the surface of a sample, ionize the resulting gas, and transfer the ionized gas for further analysis. The surface ionizer includes a sampling area, a radiation source configured to output a band of electromagnetic radiation towards the sampling chamber, and an ion transfer line coupled to the housing. The ion transfer line is in fluid communication with the sampling area and is configured to direct vapor from the sampling area to an analysis device. The analysis device is configured to screen the vapor for the substance of interest.

The aforementioned and other embodiments of the present specification shall be described in greater depth in the drawings and detailed description provided below.

BRIEF DESCRIPTION OF THE DRAWINGS

These and other features and advantages of the present invention will be further appreciated, as they become better understood by reference to the detailed description when considered in connection with the accompanying drawings.

Figure 1:
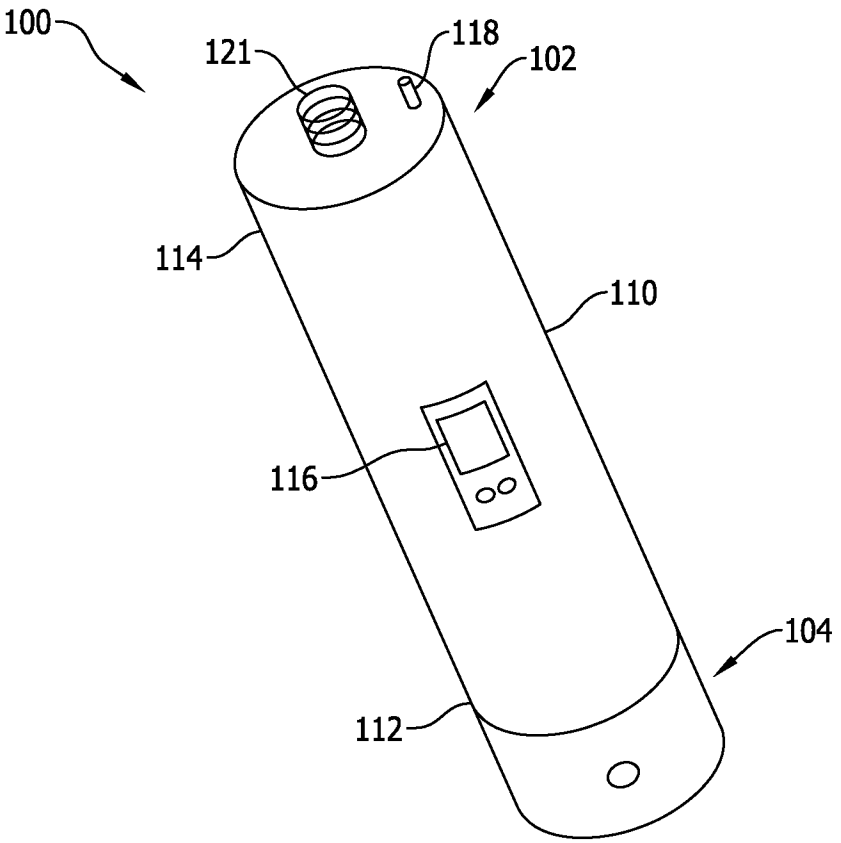
FIG. 1 illustrates a perspective view of an exemplary surface ionizer.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

The present specification is directed towards multiple embodiments. The following disclosure is provided in order to enable a person having ordinary skill in the art to practice the invention. Language used in this specification should not be interpreted as a general disavowal of any one specific embodiment or used to limit the claims beyond the meaning of the terms used therein. The general principles defined herein may be applied to other embodiments and applications without departing from the spirit and scope of the invention. Also, the terminology and phraseology used is for the purpose of describing exemplary embodiments and should not be considered limiting. Thus, the present invention is to be accorded the widest scope encompassing numerous alternatives, modifications and equivalents consistent with the principles and features disclosed. For purpose of clarity, details relating to technical material that is known in the technical fields related to the invention have not been described in detail so as not to unnecessarily obscure the present invention.

In the description and claims of the application, each of the words "comprise" "include" and "have", and forms thereof, are not necessarily limited to members in a list with which the words may be associated. It should be noted herein that any feature or component described in association with a specific embodiment may be used and implemented with any other embodiment unless clearly indicated otherwise.

In the following specification and the claims, a number of terms are referenced that have the following meanings.

The singular forms "a," "an," and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

Embodiments described herein allow for disruption by ablation, evaporation, and/or sublimation of a shallow surface layer of a sample material at atmospheric pressure thereby transferring surface residues into the gas phase as neutral or charged species, concurrent with additional gas phase ionization of neutral species to allow analysis by ion mobility or mass spectrometry. Embodiments do so without requiring mechanical swabs or traps for the collection of surface residue.

Embodiments utilize an electromagnetic radiation source to produce a band of electromagnetic radiation having a wavelength distribution between 10 nanometers and 124 nanometers, commonly referred to as extreme or high-energy ultraviolet radiation. In an embodiment, an extreme ultraviolet light source, hereafter EUV light source, is used to apply EUV radiation for disruption and ionization of the surface layer of a sample and any residue deposited thereon. The EUV light source has many benefits over the use of a conventional desorber with a separate ionization step, including, for example, coverage of a wider range of substrate materials, lack of ozone formation, easy miniaturization, rapid cycle time, relatively low power requirements, and a small footprint. Furthermore, it is non-radioactive, compatible with conventional ion mobility and mass spectrometry instrumentation, and can increase the ion concentration as well as disruption depth and power by changing the anode material, anode current, or electron acceleration voltage. In addition to covering a wider range of substrates, information about the surface being probed may be obtained, allowing for corrections of the transfer efficiency as a function of the surface substrate.

Trace detection systems that embody the ionization source described herein may further include a control system, processor, or other computing device for operating the EUV light source and associated equipment, for example, activating the EUV light source for a controlled duration. EUV light sources are commercially available and are used for surface analysis using x-ray fluorescence and neutralization of static electricity on semiconductors and aerosols.

Figure 2:
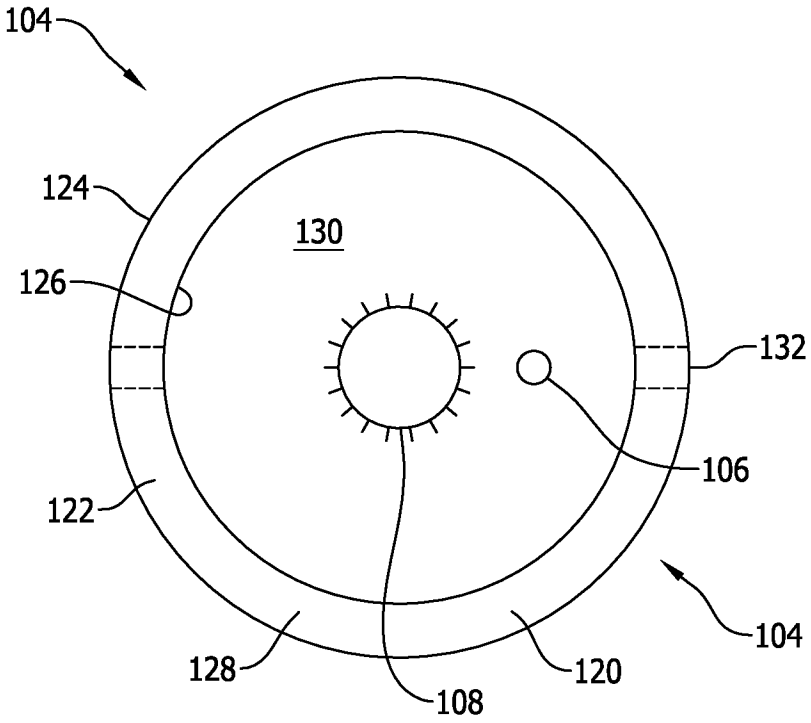
FIG. 2 illustrates a bottom view of a proximal end of the exemplary surface ionizer shown in FIG. 1.

FIG. 1 is a perspective view of an exemplary surface ionizer 100 for use in a trace detection system. FIG. 2 is another view of the surface ionizer 100 shown in FIG. 1. Surface ionizer 100 is configured to sample a surface (not shown) proximate an ion transfer line 106 and an EUV light source 108. The surface may be an original surface of an object being tested, such as the surface of a suitcase, or it may be a secondary surface, such as a trap that has been swabbed across the surface of a suitcase. In certain embodiments, the trap may be transparent to EUV light. A housing 110 secures ion transfer line 106 and EUV light source 108. Housing 110 has a proximal end 112 proximate EUV light source 108 and a distal end 114 spaced apart from proximal end 112 along a longitudinal axis. Housing 110 may completely encapsulate ion transfer line 106 and EUV light source 108, or in some embodiments, ion transfer line 106 and/or EUV light source 108 may be external to housing 110.

Housing 110 contains a controller 116 for operation of EUV light source 108 and ion transfer line 106. In some embodiments, a controller may be a separate component operably coupled to EUV light source 108 and/or ion transfer line 106. Ion transfer line 106 may be heated to a temperature ranging from 100 to 300 degrees centigrade to aid in sampling. Housing 110 may contain a battery (not shown) for powering a heater for the ion transfer line 106 and EUV light source 108, or the power may be provided external to housing 110 by way of a wired connection 118. Surface ionizer 100 may be configured to operably connect ion transfer line 106 to an analyzer for analyzing residue disrupted by EUV light source 108 and collected by ion transfer line 106. In embodiments, the residue collection by ion transfer line 106 is aided by pressure difference and/or electrostatic gradient. In an embodiment, an internal or external pump such as a vacuum pump in pressure, fluid or air communication with the ion transfer line 106 may also be used to enable collection of the residue by the ion transfer line 106.

In embodiments, ion transfer line 106 is a hollow conduit extending from the proximal end 112 to the distal end 114 of the ionizer 100. In an embodiment, housing 110 comprises a threaded connection 121 in fluid communication with ion transfer line 106 and configured to attach to an analyzer (not shown). In one embodiment, an outer edge of the ion transfer line 106 (preferably defined as a point on the perimeter of the cylindrical opening to the ion transfer line) and an outer edge of the EUV light source 108 (preferably defined as a point on the perimeter of the surface emitting the ultraviolet radiation) are separated by a distance less than 40 cm, preferably less than 20 cm, and more preferably in a range of 1 mm to 40 mm. It should be appreciated that, for the ion transfer line to effectively capture disrupted residue or for the device to be effectively used as a handheld investigatory system, the ion transfer tube needs to be within a predefined distance from the EUV light source 108.

Housing 110 is configured to position EUV light source 108 and ion transfer line 106 at predetermined distance from a sampling area. In an embodiment, the EUV light source 108 and ion transfer line 106 are at a distance of less than 50 cm, preferably less than 10 cm, more preferably in a range of 1 mm to 20 mm, and most preferably no more than 2 mm from the sample surface to be ionized. In some embodiments, a sample comprises an object that has been swabbed with a trap. The trap is then moved to within a predetermined distance from the EUV light source 108 and ion transfer line 106. In some embodiments, the predetermined distance ranges from 1 mm to 20 mm. An annular protrusion 120 extends from proximal end 112 of housing 110. Annular protrusion 120 may be integrally formed with housing 110 as a single piece, or it may be a separate piece secured to housing 110. Annular protrusion 120 has a wall 122 with an outer surface 124, an inner surface 126, a proximal surface 128, and a recess 130. Proximal surface 128 interfaces with a sample surface; while the depth of recess 130 positions EUV light source 108 and ion transfer line 106 at a predefined distance (equal to the depth 130) from the sample surface.

Within recess 130, wall 122 protects EUV light source 108 and ion transfer line 106, reducing the likelihood of damage to EUV light source 108 and ion transfer line 106 in case of accidental contact with the sample or other objects. Additionally, annular protrusion 120 provides a shield for EUV light source 108, reducing incidences of accidental exposure to an operator and the surrounding environment. In various embodiments, materials that are transparent/semi-transparent to EUV are not used for construction of the housing 110. Rather, materials that are opaque are used for construction of the housing 110. Wall 122 has at least one passageway 132 providing fluid communication from outer surface 124 to inner surface 126. In operation, EUV light source 108 radiates EUV radiation, disrupting and ionizing the sample surface. Air over the sample surface captures the vaporized surface layer and residue and flows through the passageway 132, and into ion transfer line 106. In embodiments, the passageway 132 minimizes EUV light from escaping, so is preferably of a small diameter is constructed at an angle with the sample surface; wherein the angle is based on a required surface coverage and/or vortex formation. In various embodiments, a plurality of such passageways may be provided. Ion transfer line 106 collects the air along with the captured disrupted sample surface and residue. In some embodiments, the resulting ionized vapor is collected at an air flow rate between 50 milliliters per minute and 2,000 milliliters per minute. In embodiments, the residue collection by ion transfer line 106 is aided by pressure difference obtained by using an internal or external pump such as a vacuum pump. In other embodiments, the pressure difference may be achieved by using a compressor and a flexible hose connected to passageway(s) 132 creating a gas pressure difference between the EUV source 108 (maintained at a high pressure) and the analysis device (maintained at a low pressure).

Figure 3:
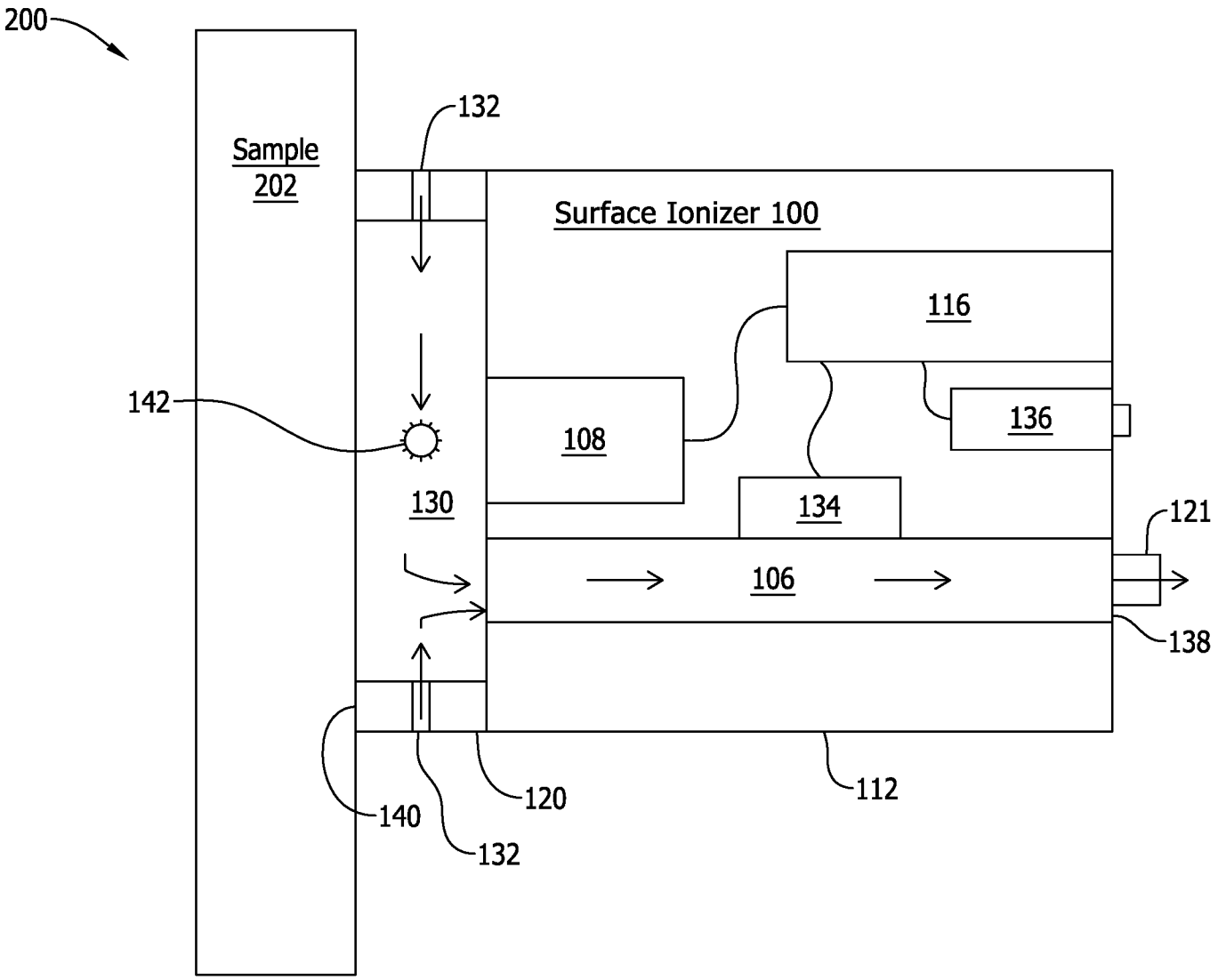
FIG. 3 illustrates a block diagram of an exemplary surface ionizer.

FIG. 3 is a block diagram of a system 200 comprising a surface ionizer 100, shown in FIG. 1 and FIG. 2. Surface ionizer 100 includes EUV light source 108 and ion transfer line 106 contained in housing 110. Controller 116 is operably connected to EUV light source 108. Ion transfer line 106 includes a heater 134 operably coupled to ion transfer line 106 and controller 116. A power supply 136 is operably connected to control panel 116 to supply electrical power for operation of surface ionizer 100.

EUV light source 108 is configured to emit a band of electromagnetic radiation in the EUV spectrum. In one embodiment, EUV light source 108 emits a band of electromagnetic waves having a wavelength distribution ranging from 10 to 124 nanometers. One example of a suitable EUV light source is a Moxtek Ion Cannon, model number MOX-10 available from MOXTEK, Inc. of Orem, Utah.

Ion transfer line 106 is operable to transfer ions from sample surface to a connection 121 for connecting to an analyzer. In some embodiments, ion transfer line is a stainless steel capillary heated to a temperature greater than 130 degrees Celsius, (for example to 270 degrees Celsius) capable of transferring ions at a flow rate of 400 ml/min to an analyzer. In one embodiment, the ion transfer tube has a longitudinal length in a range of 10 mm to 45 mm and an inner diameter in a range of 1 mm to 5 mm. It should be appreciated that the dimensional range of the ion transfer tube is important because it effects the efficacy of the ion transfer tube's ability to capture and transfer captured ions. In various embodiments, the ion transfer line 106 is constructed by using materials that remain non-reactive at elevated temperatures and is conductive in order to prevent charging of the internal surfaces of the ion transfer line 106 due to inadvertent landing of ions/charged particles on the surface. Inner surfaces of the ion transfer line 106 are polished for preventing turbulence in the sample surface. Air is removed from ion transfer line 106 at a distal end 138 by way of connection 121 to an analyzer.

Operation of surface ionizer 100 will be described in relation to FIG. 3. Initially, EUV light source 108 is unpowered and does not emit any electromagnetic radiation. To begin a test, sample 202 is brought into contact with a sample area 140 of the surface ionizer 100. This may be accomplished by moving sample 202 to a fixed surface ionizer 100, surface ionizer 100 may be maneuvered to sample 202, or sample 202 and surface ionizer 100 may both be moved. Ion transfer line 106 is operable to transfer ionized vapor through housing 110. In some embodiments, the transfer of ionized vapor may be produced by a flow of air, an electrostatic force gradient, or a combination of air flow and electrostatic force gradient. In some embodiments, there may be a constant flow of air passing through the ion transfer line 106, or the air flow may be selective, flowing only when a sample is being tested. In embodiments, pressure difference for causing air flow is obtained by using an internal or external pump such as a vacuum pump. In other embodiments, the pressure difference may be achieved by using a compressor and a flexible hose connected to passageway(s) 132 creating a gas pressure difference between the EUV source 108 (maintained at a high pressure) and the analysis device.

Once sample 202 is in place, control panel 116 powers EUV light source 108 causing it to emit EUV electromagnetic radiation towards sample 202. In an embodiment, a proximity switch may be placed in the surface ionizer 100 to turn the EUV light source 108 on/off based on the required state of the sample and flowrate. In embodiments, accidental exposure of a user to EUV light by accidentally tripping a manual switch ON is prevented by using a sensor based switching mechanism. The EUV electromagnetic radiation is delivered at atmospheric pressure to energize a shallow sample-air interface adjacent sample area 140 of surface ionizer 100 in order to disrupt the surface layer of sample 202. This disruption results in breaking up and ejecting a thin layer of sample 202 and any residue deposited on the surface as neutrals or as ions as shown by exaggerated disrupted material 142. In some embodiments, the electromagnetic radiation source disrupts the surface of the sample through ablation by electromagnetic radiation of the sample. Additionally, EUV light source 108 causes simultaneous ionization of the neutral molecules that make up the atmospheric gas phase at the solid-gas phase interface. Thus, EUV light source 108 provides a source for ionization of neutral disrupted explosives, dopants, and substrate material, and causes local heating in the solid phase by photon absorption. In an embodiment, the EUV source 108 may be used as a source of Infrared radiation producing heat.

In some embodiments, the EUV light source 108 is configured to be activated for a length of time based on a type of ions in the ionized vapor detected by the analysis device. In one embodiment, the analysis device, as described below, receives the ions and determines a type, class, or category of the sampled ions. The analysis device communicates data indicative of at least one of the type, class, or category of the sampled ions to the controller. Based on the type, class, or category of the sampled ions, the controller determines a preferred length of time for the EUV light source to be activated and compares the preferred length of time to an internal clock configured to track (by concurrently turning on and off with) the activation and deactivation of the EUV light source. Based on the comparison, if the preferred length of time has not been reached, then the controller keeps the EUV light source on. Based on the comparison, if the preferred length of time has been reached, then the controller turns the EUV light source off.

Application of EUV light source 108 results in an ionized gas phase containing disrupted material 142 of sample 202 and any surface residue deposited thereon. The ionized gas phase is contained between surface ionizer 100 and sample 202. This gas phase is sampled by ion transfer line 106 to deliver ionized gas to a separate analyzer (not shown) for detection of components in a conventional manner. In one embodiment, gas flows passively under a pressure gradient and carries ions with it in the direction of the analysis device. In an embodiment, ion transport through the ion transfer line is aided by providing an electric field gradient, using an electric field or voltage source in electrical communication with the ion transfer line, in the direction of the analysis device. The ionized gas may move through the general transfer of the air, or in some embodiments an electrostatic force gradient may cause the movement of the ions. In some embodiments a combination of air transfer and an electrostatic force gradient may cause the transfer of the ionized gas. Air removed by ion transfer line 106 from cavity 130 is replaced by air flowing through passages 132 in annular ring 120 as well as any gaps between annular ring 120 and sample 202. In some embodiments, the system 200 further comprises at least one switch configured to deactivate the electromagnetic radiation source, or EUV light source 108, after ionized vapor has been transferred from the ion transfer line 106 to the analysis device. In various embodiments, the at least one switch comprises a safety switch, a software based time delay switch, or an intensity threshold sensor of the analysis device, configured to control a deactivation of the electromagnetic radiation source.

Figure 4:
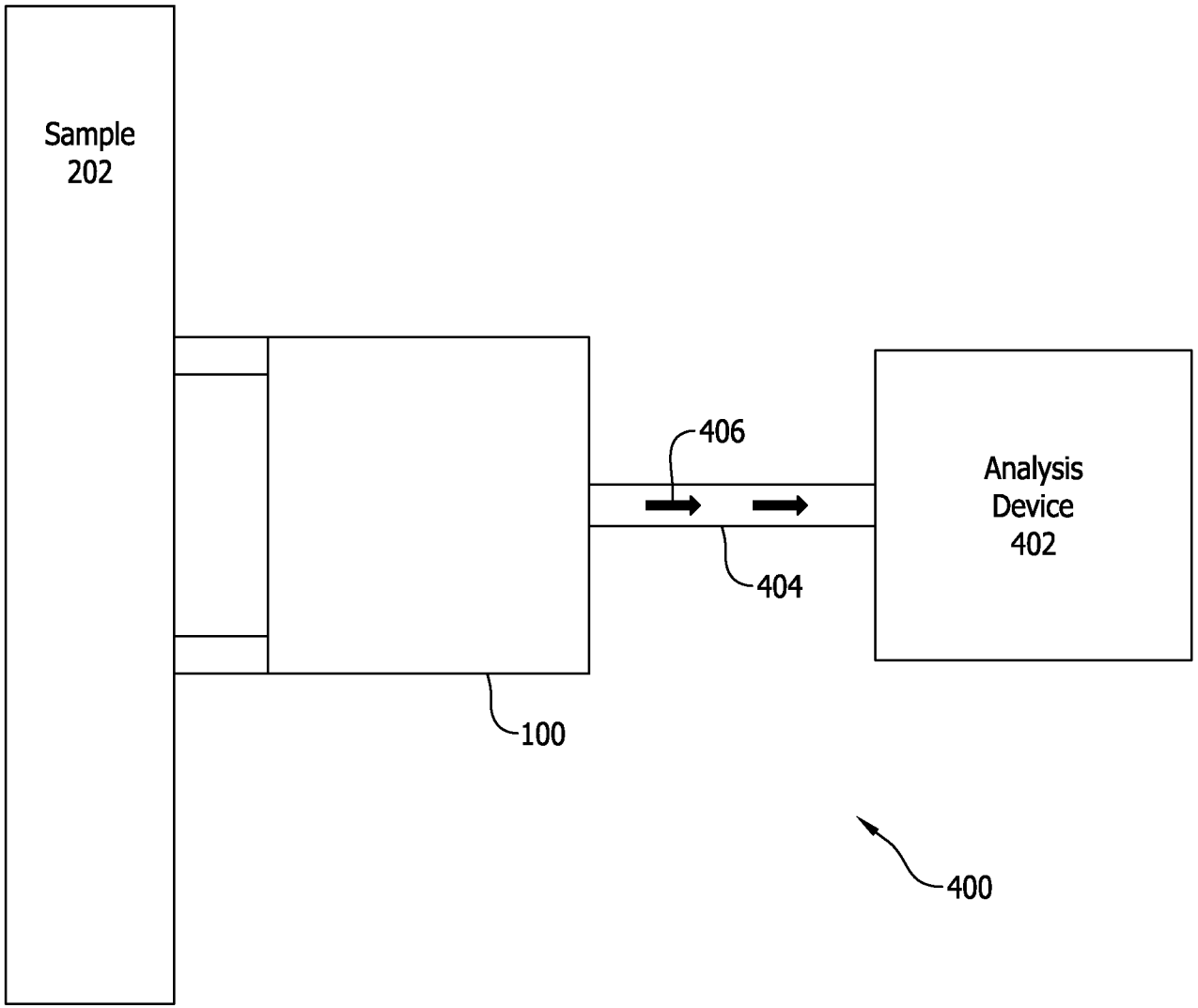
FIG. 4 illustrates a block diagram of an exemplary trace detection system.

FIG. 4 is a block diagram of an exemplary trace detection system 400 embodying surface ionizer 100, shown in FIGS. 1 through 3. Trace detection system 400 further includes an analysis device 402 in fluid communication with ion transfer line 106. Fluid communication may be provided through a hose 404. Ionized gas produced by surface ionizer 100 is transferred to analysis device 402 for screening. Arrows 406 indicate direction of vapor transfer from surface ionizer 100 to analysis device 402. Analysis device 402 is configured to screen the ionized vapor for a substance of interest. If present, the substance of interest is detected and identified by analysis device 402.

Substances of interest may include at least one of an explosive, an energetic material, a taggant, a narcotic, a pharmaceutical product, a toxin, a chemical warfare agent, a biological warfare agent, a pollutant, a pesticide, a toxic industrial chemical, a toxic industrial material, a homemade explosive, a pharmaceutical trace contaminant, a biomarker for medical applications, a chemical marker for medical applications, a biomarker for clinical hygienic applications, a chemical marker for clinical hygienic applications, a precursor thereof, a byproduct thereof, a metabolite thereof, and combinations thereof. In various embodiments, the surface ionizer of the present specification may be used with materials having high electron affinity (negative ion mode), high proton affinity (positive ion mode), and/or low interaction energy with surface.

In trace detection system 400, analysis device 402 may include at least one of an ion mobility spectrometer (IMS), an ion trap mobility spectrometer (ITMS), a drift spectrometer (DS), a non-linear drift spectrometer, a field ion spectrometer (FIS), a radio frequency ion mobility increment spectrometer (IMIS), a field asymmetric ion mobility spectrometer (FAIMS), an ultra-high-field FAIMS, a differential ion mobility spectrometer (DIMS) and a differential mobility spectrometer (DMS), a traveling wave ion mobility spectrometer, a semiconductor gas sensor, a raman spectrometer, a laser diode detector, a mass spectrometer (MS), an electron capture detector, a photoionization detector, a chemiluminescence-based detector, an electrochemical sensor, an infrared spectrometer, a lab-on-a-chip detector, and combinations thereof.

Figure 5:
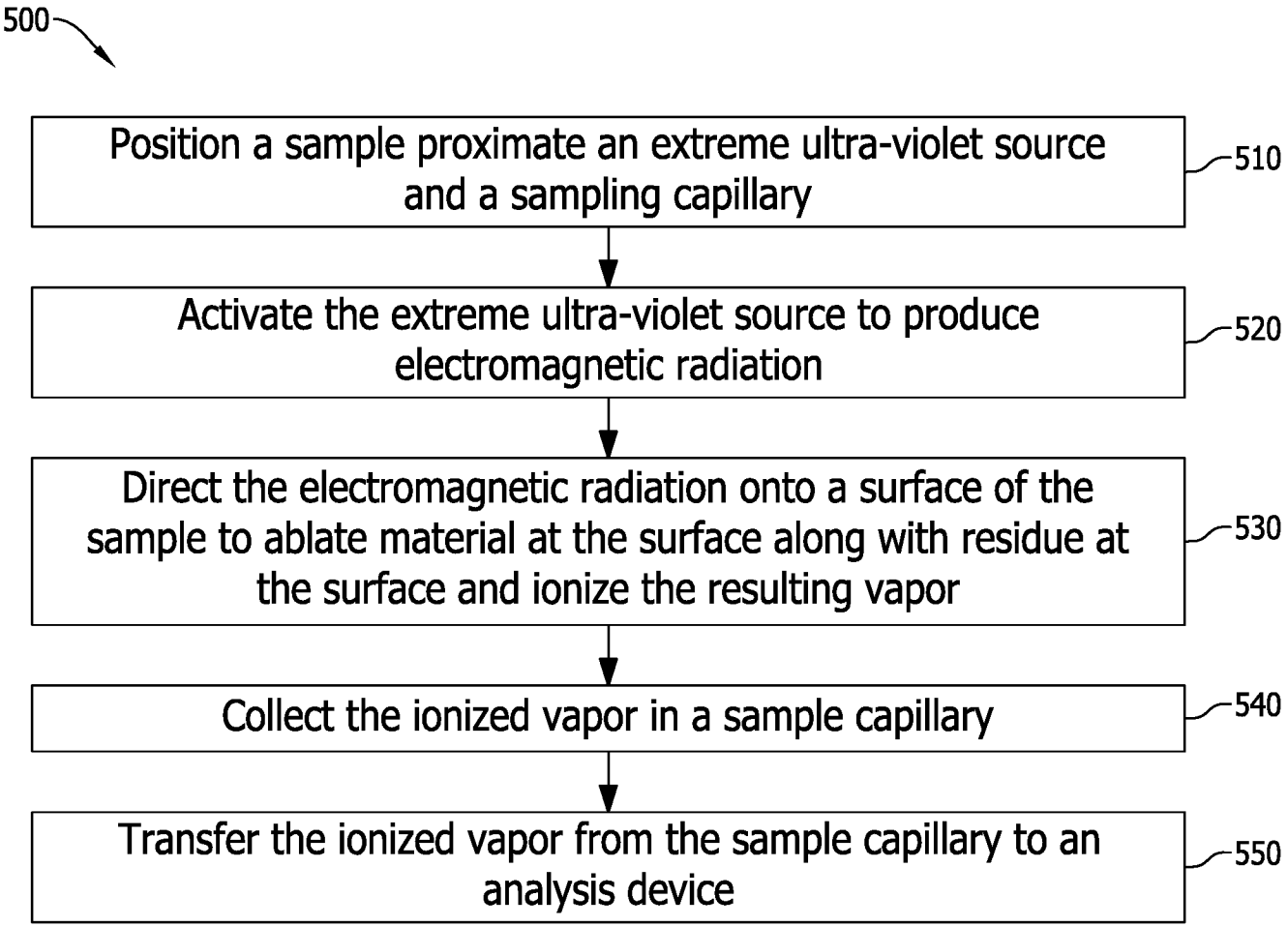
FIG. 5 is a block diagram of an exemplary method for surface ionization.

FIG. 5 is a flow diagram of an exemplary method 500 of operating trace detection system 400 shown in FIG. 4, including surface ionizer 100, shown in FIGS. 1 through 3. Method 500 includes positioning 510 sample 202 proximate EUV light source 108 and ion transfer line 106, and activating 520 EUV light source 108 to produce electromagnetic radiation. In some embodiments, positioning the sample 202 comprises swabbing an object with a trap and moving the trap to within a distance ranging from 1 mm to 20 mm of the EUV light source 108 and the ion transfer line 106. In some embodiments, the EUV light source 108 is activated for a length of time based on a type of ions in the ionized vapor detected by the analysis device. The method further includes directing 530 the electromagnetic radiation onto a surface of sample 202 to disrupt material at the surface along with residue deposited thereon and to ionize the resulting vapor. In some embodiments, the electromagnetic radiation source disrupts the surface of the sample through ablation by electromagnetic radiation of the sample. Method 500 also includes collecting 540 the ionized vapor in ion transfer line 106. Method 500 further includes transferring 550 the collected vapor from ion transfer line 106 to analysis device 302 for analysis. In some embodiments, the method further comprises deactivating the EUV light source 108 after transferring the ionized vapor from the ion transfer line 106 to the analysis device 302, the deactivation being controlled by at least one of a safety switch, a software based time delay switch or an intensity threshold sensor of the analysis device. Analysis device 302 is configured to screen the vapor for a substance of interest.

An exemplary technical effect of the methods, systems, and apparatus described herein includes at least one of: (a) increasing sample throughput capabilities of a trace detection system by combining the functions of a desorber and ionizer into a single unit; (b) reducing the power required to ionize a sample (c) reducing the size of equipment for obtaining ions for analysis; (d) increasing overall system performance and efficiency by accurately and rapidly identifying a wide range of substances of interest, and (e) increased compatibility with multiple substrate materials.

Exemplary embodiments of methods, systems, and apparatus for surface ionizers are not limited to the specific embodiments described herein, but rather, components of systems and/or steps of the methods may be utilized independently and separately from other components and/or steps described herein. For example, the methods may also be used in combination with other non-conventional ion sources and trace detection systems, and are not limited to practice with only the systems and methods as described herein. Rather, the exemplary embodiment can be implemented and utilized in connection with many other applications, equipment, and systems that may benefit from increased efficiency, reduced operational cost, and reduced capital expenditure.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

Some embodiments involve the use of one or more electronic or computing devices. Such devices typically include a processor or controller, such as a general purpose central processing unit (CPU), a graphics processing unit (GPU), a microcontroller, a reduced instruction set computer (RISC) processor, an application specific integrated circuit (ASIC), a programmable logic circuit (PLC), and/or any other circuit or processor capable of executing the functions described herein. The methods described herein may be encoded as executable instructions embodied in a computer readable medium, including, without limitation, a storage device and/or a memory device. Such instructions, when executed by a processor, cause the processor to perform at least a portion of the methods described herein. The above examples are exemplary only, and thus are not intended to limit in any way the definition and/or meaning of the term processor.

The above examples are merely illustrative of the many applications of the system of present specification. Although only a few embodiments of the present invention have been described herein, it should be understood that the present invention might be embodied in many other specific forms without departing from the spirit or scope of the invention. Therefore, the present examples and embodiments are to be considered as illustrative and not restrictive, and the invention may be modified within the scope of the appended claims.

The invention claimed is:

1. A surface ionizer comprising:

a housing having a sampling area;

a radiation source positioned within the housing and configured to emit electromagnetic radiation towards the sampling area, wherein the electromagnetic radiation has a wavelength distribution between 10 nanometers and 124 nanometers; and an ion transfer line coupled to the housing, the ion transfer line in fluid communication with the sampling area and configured to direct ionized vapor from the sampling area to an analysis device, wherein the radiation source is configured to be activated for a length of time based on a type of ions in the ionized vapor detected by the analysis device.

2. The surface ionizer of claim 1 wherein the ion transfer line is external to the housing, comprises materials that are non-reactive and is positioned within a range of 1 mm to 40 mm of the radiation source.

3. The surface ionizer of claim 1, wherein the housing encapsulates both the radiation source and the ion transfer line.

4. The surface ionizer of claim 1, wherein the sampling area comprises a sampling chamber having an opening for receiving a sample, wherein an end of the ion transfer line is disposed in a wall of the sampling chamber and the opening for receiving a sample is disposed on an opposite side of the sampling chamber from the ion transfer line.

5. The surface ionizer of claim 1, wherein the sampling area comprises a sampling chamber having a wall having an exterior surface, an interior surface, and at least one open passage between the exterior surface and the interior surface.

6. The surface ionizer of claim 1, further comprising a heating element positioned in the housing and configured to heat the ion transfer line to a temperature greater than 130 degrees Celsius.

7. The surface ionizer of claim 1, wherein the ion transfer line is configured to direct ionized vapor by way of at least one of an electrostatic force gradient or a pressure gradient for enabling the ionized vapor to move towards the analysis device.

8. A method of operating a trace detection system for detecting a substance of interest within a sample, the method comprising:

positioning a sample proximate an electromagnetic radiation source and an ion transfer line;

activating the electromagnetic radiation source to produce electromagnetic radiation having a wavelength distribution between 10 nanometers and 124 nanometers;

directing the electromagnetic radiation onto a surface of the sample to disrupt material at the surface along with residue at the surface and ionize the resulting vapor to generate ionized vapor;

collecting the ionized vapor in the ion transfer line; and transferring the ionized vapor from the ion transfer line to an analysis device configured to screen the vapor for the substance of interest, wherein the electromagnetic radiation source is activated for a length of time based on a type of ions in the ionized vapor detected by the analysis device.

9. The method of claim 8, wherein positioning the sample comprises moving the sample to within a distance ranging from 1 mm to 20 mm of the electromagnetic radiation source and ion transfer line.

10. The method of claim 8, wherein positioning the sample comprises swabbing an object with a trap and moving the trap to within a distance ranging from 1 mm to 20 mm of the electromagnetic radiation source and the ion transfer line.

11. The method of claim 8, further comprising deactivating the electromagnetic radiation source after transferring the ionized vapor from the ion transfer line to the analysis device, the deactivation being controlled by at least one of a safety switch, a software based time delay switch or an intensity threshold sensor of the analysis device.

12. The method of claim 8, wherein the ionized vapor is collected by the ion transfer line by a flow of air obtained by creating a pressure difference between the sampling area and the analysis device.

13. The method of claim 8, wherein a housing secures the electromagnetic radiation source and the ion transfer line and contains a sample chamber operable to secure the sample, wherein the electromagnetic radiation is directed at a side of the sample facing the ion transfer line and wherein the electromagnetic radiation source and the ion transfer line are positioned in a range of 1 mm to 40 mm from each other.

14. The method of claim 8, wherein the electromagnetic radiation is directed to a first side of the sample and the ion transfer line is directed at a second side of the sample opposite the first side.

15. The method of claim 8, wherein collecting the ionized vapor includes generating the air flow at a rate between 50 milliliters per minute and 2000 milliliters per minute.

16. The method of claim 8, wherein the electromagnetic radiation source disrupts the surface of the sample through ablation by electromagnetic radiation of the sample.

17. The method of claim 8, wherein the substance of interest includes at least one of an explosive, an energetic material, a taggant, a narcotic, a pharmaceutical product, a toxin, a chemical warfare agent, a biological warfare agent, a pollutant, a pesticide, a toxic industrial chemical, a toxic industrial material, a homemade explosive, a pharmaceutical trace contaminant, a biomarker for medical applications, a chemical marker for medical applications, a biomarker for clinical hygienic applications, a chemical marker for clinical hygienic applications, a precursor thereof, a byproduct thereof, a metabolite thereof, or combinations thereof.

18. The method of claim 8, wherein the analysis device includes at least one of an ion mobility spectrometer (IMS), an ion trap mobility spectrometer (ITMS), a drift spectrometer (DS), a non-linear drift spectrometer, a field ion spectrometer (FIS), a radio frequency ion mobility increment spectrometer (IMIS), a field asymmetric ion mobility spectrometer (FAIMS), an ultra-high-field FAIMS, a differential ion mobility spectrometer (DIMS) and a differential mobility spectrometer (DMS), a traveling wave ion mobility spectrometer, a semiconductor gas sensor, a raman spectrometer, a laser diode detector, a mass spectrometer (MS), an electron capture detector, a photoionization detector, a chemiluminescence-based detector, an electrochemical sensor, an infrared spectrometer, a lab-on-a-chip detector, or combinations thereof.

* * * * *